US007424259B2

(12) United States Patent
Samei et al.

(10) Patent No.: US 7,424,259 B2
(45) Date of Patent: Sep. 9, 2008

(54) FIXING APPARATUS

(75) Inventors: Masahiro Samei, Osaka (JP); Noboru Katakabe, Kyoto (JP); Masaru Imai, Osaka (JP); Hideaki Yamada, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 329 days.

(21) Appl. No.: 10/576,307

(22) PCT Filed: Oct. 5, 2004

(86) PCT No.: PCT/JP2004/014649

§ 371 (c)(1),
(2), (4) Date: Apr. 19, 2006

(87) PCT Pub. No.: WO2005/038534

PCT Pub. Date: Apr. 28, 2005

(65) Prior Publication Data

US 2007/0122214 A1 May 31, 2007

(30) Foreign Application Priority Data

Oct. 21, 2003 (JP) ..... 2003-361051

(51) Int. Cl.
*G03G 15/20* (2006.01)

(52) U.S. Cl. ..... 399/329; 219/619; 399/328

(58) Field of Classification Search ..... 399/329, 399/328; 219/619
See application file for complete search history.

(56) References Cited

U.S. PATENT DOCUMENTS 5,526,103 A 6/1996 Kato et al.
6,872,925 B2 * 3/2005 Asakura et al. ..... 219/619
7,122,768 B2 10/2006 Imai et al.
2004/0099650 A1 5/2004 Imai et al.

(Continued)

FOREIGN PATENT DOCUMENTS

JP 62-150371 7/1987

(Continued)

OTHER PUBLICATIONS

English Language Abstract of JP 10-074007, Mar. 17, 1998.

(Continued)

*Primary Examiner*—Susan S Lee
(74) *Attorney, Agent, or Firm*—Greenblum & Bernstein, P.L.C.

(57) ABSTRACT

A fixing apparatus that enables the calorific value of a heat-producing rotating element to be stabilized and the heat production efficiency of that heat-producing rotating element to be improved. A fixing apparatus (200) is equipped with a heat-producing sleeve (210), an induction heating apparatus (230), a magnetic field absorption member (233) that absorbs a magnetic field generated by the induction heating apparatus (230), and a fixing roller (240) and pressure roller (250) that grip and rotate the heat-producing sleeve (210). The magnetic field absorption member (233) is located in an area opposite an exciting coil (231) with the heat-producing sleeve (210) between, and absorbs a magnetic field generated by the induction heating apparatus (230). The heat-producing sleeve (210) is composed of a nonmagnetic metallic material of thickness in the range from 10 μm to 500 μm and specific resistance of $80\times10^{-6}$ Ωcm or less.

6 Claims, 5 Drawing Sheets

U.S. PATENT DOCUMENTS

| | | | | |
|---|---|---|---|---|
| 2004/0161270 | A1 | 8/2004 | Asakura et al. | |
| 2005/0199613 | A1 | 9/2005 | Samei et al. | |
| 2005/0201768 | A1 | 9/2005 | Tatematsu et al. | |
| 2006/0029411 | A1* | 2/2006 | Ishii et al. | 219/619 |
| 2006/0045587 | A1* | 3/2006 | Cho et al. | 399/328 |
| 2006/0099001 | A1 | 5/2006 | Asakura et al. | |

FOREIGN PATENT DOCUMENTS

| | | |
|---|---|---|
| JP | 5-9027 | 2/1993 |
| JP | 7-319312 | 12/1995 |
| JP | 10-074007 | 3/1998 |
| JP | 2000-268952 | 9/2000 |
| JP | 2002-55549 | 2/2002 |
| JP | 2002-148983 | 5/2002 |
| JP | 2002-328550 | 11/2002 |
| JP | 2004-145368 | 5/2004 |
| WO | 03/039198 | 5/2003 |

OTHER PUBLICATIONS

English Language Abstract of JP 2004-145368, May 20, 2004.
English Language Abstract of JP 2002-148983, May 22, 2002.
English Language Abstract of JP 2002-328550, Nov. 15, 2002.
English Language Abstract of JP 7-319312, Dec. 8, 1995.
U.S. Appl. No. 10/554,945 to Yasuda et al., filed Apr. 11, 2006.
U.S. Appl. No. 10/575,356 to Yasuda et al., filed Apr. 11, 2006.
U.S. Appl. No. 10/575,353 to Yasuda et al., filed Apr. 11, 2006.
U.S. Appl. No. 10/565,270 to Yasuda et al., filed Apr. 11, 2006.
English language Abstract of WO 03/039198, May 8, 2003.
English language Abstract of JP 2002-55549, Feb. 20, 2002.
English langauge Abstract of JP 2000-268952, Sep. 29, 2000.
English lanuage Abstract of JP 62-150371, Jul. 04, 1987.

* cited by examiner

FIXING APPARATUS

TECHNICAL FIELD

The present invention relates to an induction heating type of fixing apparatus in an image forming apparatus such as an electrophotographic or electrostatographic copier, facsimile machine, or printer.

BACKGROUND ART

A fixing apparatus heretofore known as an induction heating (IH) type of fixing apparatus has a thin-walled heat-producing rotating element including a conductive layer that produces heat by means of induction heating and is installed in a rotatable fashion, an induction heating source comprising a magnetic flux generation section that is located opposite the outer surface of the heat-producing rotating element and induction-heats the heat-producing rotating element, a rotatable internal pressure member that is in contact with the inner surface of the heat-producing rotating element, and a rotatable external pressure member that is in contact with the outer surface of the heat-producing rotating element (see, for example, Patent Document 1).

FIG. 1 is a schematic cross-sectional drawing of a fixing apparatus disclosed in the Patent Document 1. As shown in FIG. 1, this fixing apparatus has a coil assembly 10 that generates a high-frequency magnetic field as the induction heating source, a metal sleeve 11 as the heat-producing rotating element that produces heat through induction heating by means of coil assembly 10 and is rotatably installed, a rotatable internal pressure member 12 that is in contact with the inner surface of metal sleeve 11, and a rotatable external pressure member 13 that is opposite internal pressure member 12 and is in contact with the outer surface of metal sleeve 11.

In FIG. 1, metal sleeve 11 is gripped between external pressure member 13 and internal pressure member 12, and rotates driven by the rotation of external pressure member 13.

Recording material 14 to which an unfixed toner image has been transferred is transported from the direction indicated by the arrow toward a nip area 23 formed between external pressure member 13 and metal sleeve 11. In nip area 23, heat of metal sleeve 11 heated by coil assembly 10 and pressure from both internal pressure members 12 and 13 are applied to recording material 14. By this means, an unfixed toner image is fixed onto recording material 14.

Metal sleeve 11 of this fixing apparatus is a flexible, thin, hollow metal conductor with a thickness of 20 μm to 60 μm, and includes a conductive layer formed of an electrically conductive magnetic material such as nickel, iron, or SUS430.

Coil assembly 10 of this fixing apparatus is supported by a holder (not shown) and fixed to a fixing unit frame at a predetermined distance from the outer surface of metal sleeve 11, and performs Joule heating of metal sleeve 11 opposite by inducing an induction current (eddy current) in metal sleeve 11.

In this fixing apparatus, since metal sleeve 11 is heated by means of coil assembly 10 located on the outside of metal sleeve 11, an excessive rise in the ambient temperature due to heat production by coil assembly 10 itself and thermal radiation to metal sleeve 11 can be reduced. Also, in this fixing apparatus, since an unfixed toner image is heat-fixed onto recording material 14 by heating metal sleeve 11 directly, there is little loss of heat from metal sleeve 11 during warming-up compared with a fixing apparatus in which metal sleeve 11 is heated indirectly by a supporting roller, for example. Moreover, since metal sleeve 11 is thin, the heat capacity of metal sleeve 11 itself is small, and startup responsiveness until metal sleeve 11 is heated to a predetermined fixing temperature is improved.

Also, a fixing apparatus is known that has a thin heating belt that includes a conductive layer, a magnetic field generation section that performs induction heating of that conductive layer from outside the thin heating belt, and a ferromagnet through the gap with respect to the heating belt on the opposite side of the heating belt from the magnetic field generation section, and fixes an unfixed toner image on a recording medium in a nip area between the heating belt and a pressure member located opposite (see, for example, Patent Document 2).

In this fixing apparatus, the heat capacity of the heating member is extremely small, and the warm-up time is shortened. Also, ample heat and pressure can be applied in the nip area between the heating belt and the pressure member, so that good fixability can be obtained.

Patent Document 1: Japanese Patent Application Laid-Open No. HEI10-74007

Patent Document 2: Japanese Patent Application Laid-Open No. 2004-145368

DISCLOSURE OF INVENTION

Problems to be Solved by the Invention

However, with the former fixing apparatus, since a configuration is used in which the heat-producing rotating element is gripped and rotated by a pair of pressure members, the stability of movement of the heat-producing rotating element is poor, and there is a tendency for the path of rotation of the heat-producing rotating element to fluctuate and the magnetic field generated between the magnetic field generation section and the heat-producing rotating element to vary. Thus, a deficiency of this fixing apparatus is that the calorific value of its heat-producing rotating element becomes unstable, and its heat production efficiency falls.

Fluctuation of the path of rotation of the heat-producing rotating element increases as the thickness of the heat-producing rotating element decreases. This is because, as the thickness of the heat-producing rotating element decreases, it becomes more difficult to maintain its circularity, and its travel becomes unstable. Therefore, fluctuation of the path of rotation of the heat-producing rotating element can be reduced by increasing the thickness of the heat-producing rotating element. However, if the heat-producing rotating element is made thicker, its heat capacity increases and startup responsiveness when heating is performed deteriorates.

On the other hand, with the latter fixing apparatus, since a configuration is used in which the heating belt follows the shape of the nip area between the heating belt and the pressure member, it is necessary for the heating belt to be a flexible belt, and it is required to be made as thin as possible. Therefore, the conductive layer of the heating belt must also be made thin, and there is thus a problem of not being able to obtain sufficient heat production efficiency.

It is an object of the present invention to provide a fixing apparatus that enables the calorific value of a heat-producing rotating element to be stabilized and the heat production efficiency of that heat-producing rotating element to be improved.

Means for Solving the Problem

A fixing apparatus of the present invention has a heat-producing rotating element composed of a nonmagnetic metallic material that has a predetermined specific resistance and thickness, and that is gripped and rotated by a pair of pressure members so as to pass between a magnetic field absorption section and a magnetic field generation section, the magnetic field absorption section being located opposite the magnetic field generation section that generates a magnetic field and absorbing a magnetic field generated by the magnetic field generation section, is induction-heated by a magnetic field generated by the magnetic field generation section, and allows passage of magnetic field energy.

More specifically, according to the present invention, in a fixing apparatus that includes a magnetic field generation section that generates a magnetic field, a magnetic field absorption section that is located opposite the magnetic field generation section and absorbs a magnetic field generated by the magnetic field generation section, and a heat-producing rotating element that is gripped and rotated by a pair of pressure members so as to pass between the magnetic field absorption section and the magnetic field generation section and is induction-heated by a magnetic field generated by the magnetic field generation section and allows passage of magnetic field energy, the heat-producing rotating element is composed of a nonmagnetic metallic material of thickness in the range from 10 μm to 500 μm and a specific resistance of $80\times10^{-6}$ Ωcm or less.

Advantageous Effect of the Invention

The present invention enables the calorific value of a heat-producing rotating element to be stabilized and the heat production efficiency of that heat-producing rotating element to be improved.

BEST MODE FOR CARRYING OUT THE INVENTION

Figure 1:
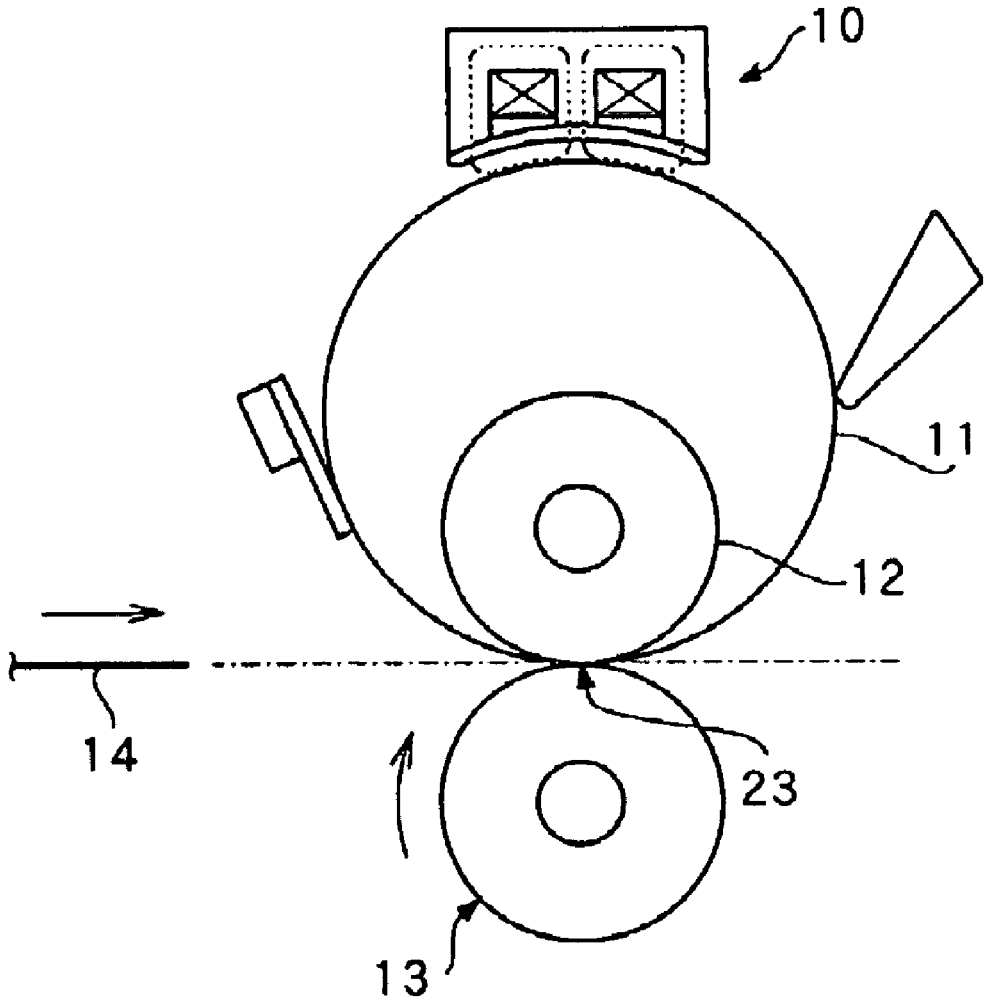
PRIOR ART FIG.1
FIG. 1 is a schematic cross-sectional drawing showing the configuration of a conventional fixing apparatus.
Figure 2:
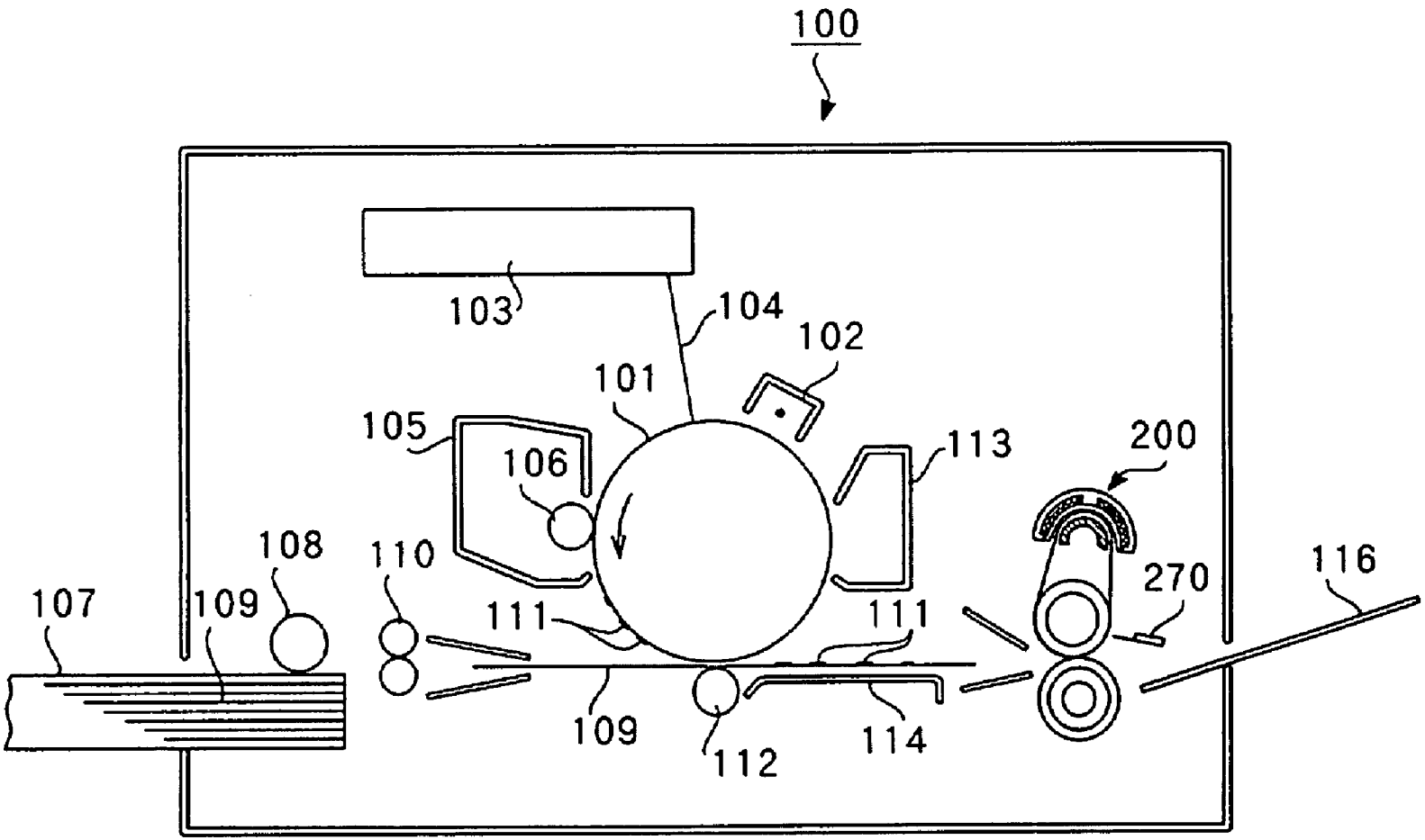
FIG. 2 is a schematic cross-sectional drawing showing the overall configuration of an image forming apparatus suitable for incorporation of a fixing apparatus according to one embodiment of the present invention.

FIG. 2 is a schematic cross-sectional drawing showing the overall configuration of an image forming apparatus suitable for incorporation of a fixing apparatus according to one embodiment of the present invention.

As shown in FIG. 2, an image forming apparatus 100 has an electrophotographic photosensitive body (hereinafter referred to as "photosensitive drum") 101, an electrifier 102, a laser beam scanner 103, a developing unit 105, a paper feed apparatus 107, a fixing apparatus 200, a cleaning apparatus 113, and so forth.

In FIG. 2, photosensitive drum 101 is rotated at a predetermined peripheral velocity in the direction indicated by the arrow while its surface is uniformly charged to a negative predetermined dark potential V0 by electrifier 102.

Laser beam scanner 103 outputs a laser beam 104 modulated in accordance with a time series electrical digital pixel signal of image information input from a host apparatus such as an image reading apparatus or computer (not shown), and performs scanning exposure of the surface of uniformly charged photosensitive drum 101 with laser beam 104. By this means, the absolute value of the potential of exposed parts of photosensitive drum 101 falls and becomes a light potential VL, and an electrostatic latent image is formed on the surface of photosensitive drum 101.

Developing unit 105 is provided with a rotated developing roller 106. Developing roller 106 is positioned opposite photosensitive drum 101, and a thin layer of toner is formed on its peripheral surface. A developing bias voltage with an absolute value smaller than dark potential V0 of photosensitive drum 101 and larger than light potential VL is applied to developing roller 106.

By this means, negatively charged toner on developing roller 106 adheres only to light potential VL parts of the surface of photosensitive drum 101, the electrostatic latent image formed on the surface of photosensitive drum 101 is developed, and an unfixed toner image 111 is formed on photosensitive drum 101.

Meanwhile, paper feed apparatus 107 feeds recording paper 109 as a recording medium one sheet at a time at predetermined timing by means of a paper feed roller 108. Recording paper 109 fed from paper feed apparatus 107 is transported through a pair of registration rollers 110 to the nip area between photosensitive drum 101 and a transfer roller 112 at appropriate timing synchronized with the rotation of photosensitive drum 101. By this means, unfixed toner image 111 on photosensitive drum 101 is transferred to recording paper 109 by transfer roller 112 to which a transfer bias is applied.

Recording paper 109 on which unfixed toner image 111 is formed and held in this way is guided by a recording paper guide 114 and separated from photosensitive drum 101, and then transported toward the fixing area of fixing apparatus 200. Once transported to this fixing area, recording paper 109 has unfixed toner image 111 heat-fixed onto it by fixing apparatus 200.

After passing through fixing apparatus 200, recording paper 109 onto which unfixed toner image 111 has been heat-fixed is ejected onto an output tray 116 attached to the outside of image forming apparatus 100.

After recording paper 109 has been separated from it, photosensitive drum 101 has residual material such as untransferred toner remaining on its surface removed by a cleaning apparatus 113, and is made ready for the next image forming operation.

Figure 3:
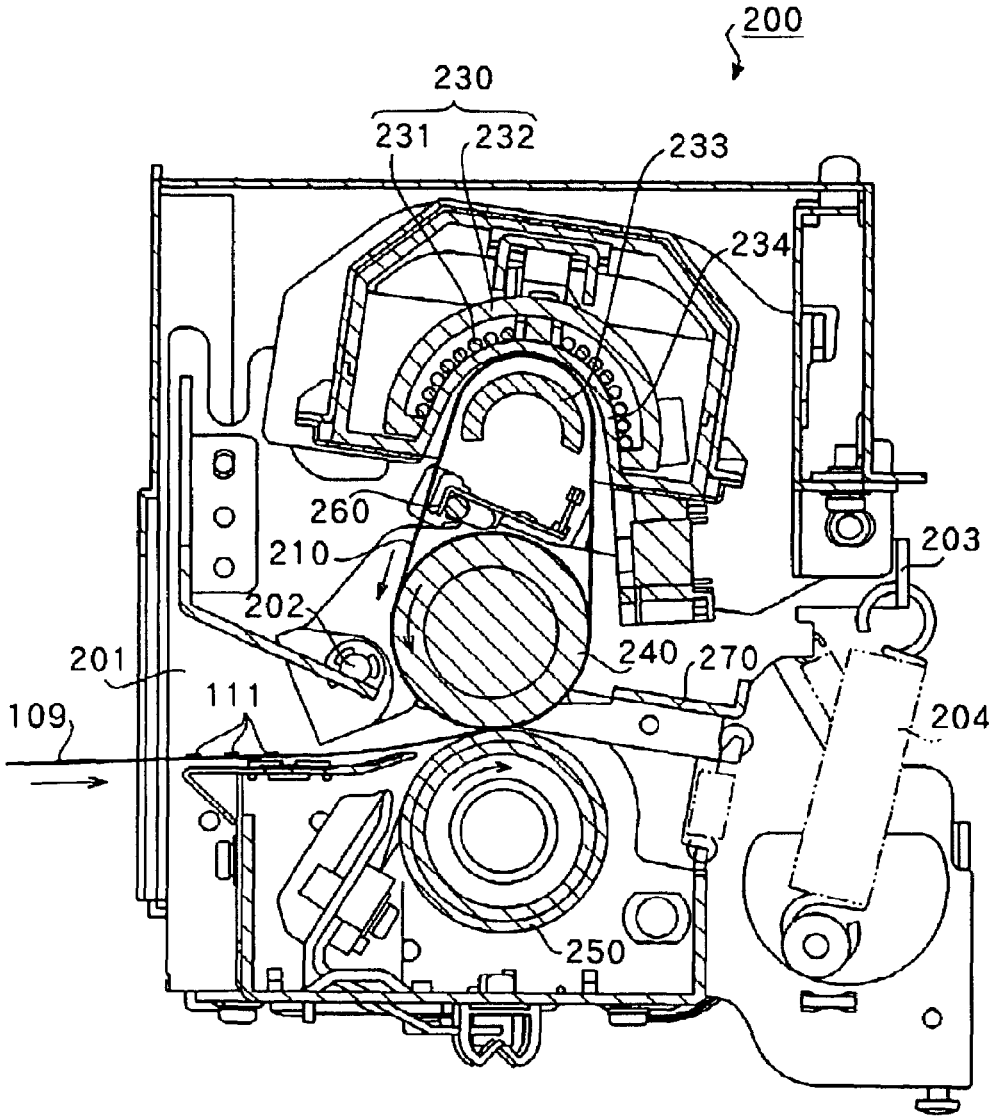
FIG. 3 is a cross-sectional drawing showing a configuration of a fixing apparatus according to the embodiment.

A fixing apparatus according to this embodiment will now be described in greater detail by giving a specific example. FIG. 3 is a cross-sectional drawing showing a configuration of a fixing apparatus according to this embodiment. As shown in FIG. 3, fixing apparatus 200 includes a heat-producing sleeve 210 serving as a heat-producing rotating element, an induction heating apparatus 230 serving as a magnetic field generation section, a magnetic field absorption member 233 serving as a magnetic field absorption section that absorbs a magnetic field generated by induction heating apparatus 230, a fixing roller 240 and pressure roller 250 serving as a pair of pressure members that grip and rotate heat-producing sleeve 210, and so forth.

In FIG. 3, heat-producing sleeve 210 is suspended on fixing roller 240 so that its upper part curves in an arc following a coil guide 234 described later herein. Having the upper part of heat-producing sleeve 210 curve in an arc following coil guide 234 in this way enables the travel of heat-producing sleeve 210 to be stabilized. Fixing roller 240 is rotatably pivoted in a rocking plate 203 attached in a freely rocking fashion to body side plate 201 by means of a short shaft 202. Pressure roller 250 is rotatably pivoted in the lower part of body side plate 201 of fixing apparatus 200.

Rocking plate 203 rocks in a clockwise direction about short shaft 202 through the contracting action of a coil spring 204. Fixing roller 240 is displaced in line with this rocking of rocking plate 203, and presses against pressure roller 250 with heat-producing sleeve 210 between.

Pressure roller 250 is rotated in the direction indicated by the arrow by a driving source (not shown). Fixing roller 240 is rotated driven by the rotation of pressure roller 250 while gripping heat-producing sleeve 210. By this means, heat-producing sleeve 210 is rotated in the direction indicated by the arrow, gripped between fixing roller 240 and pressure roller 250. By means of this gripping and rotation of heat-producing sleeve 210, a nip area for heat-fixing unfixed toner image 111 onto recording paper 109 is formed between heat-producing sleeve 210 and pressure roller 250.

Induction heating apparatus 230 comprises an IH type magnetic field generation section, and as shown in FIG. 3, has an exciting coil 231 installed along the outer peripheral surface of the part of heat-producing sleeve 210 curved in an arc following coil guide 234, and a core 232 composed of ferrite covering exciting coil 231. Exciting coil 231 is formed using litz wire comprising bundled thin wires, and the cross-sectional shape is formed as a semicircle so as to cover the outer peripheral surface of heat-producing sleeve 210.

Magnetic field absorption member 233 is provided in an area opposite exciting coil 231 with heat-producing sleeve 210 between, and absorbs a magnetic field generated by induction heating apparatus 230.

An excitation current of predetermined frequency (20 kHz to 60 kHz) is applied to exciting coil 231 of induction heating apparatus 230 from an exciting circuit (not shown). By this means, an alternating magnetic field is generated between core 232 and magnetic field absorption member 233, an eddy current is generated in the surface of heat-producing sleeve 210, and heat-producing sleeve 210 produces heat.

Core 232 is attached to the center and part of the rear of exciting coil 231. As an alternative to ferrite, a high-permeability material such as permalloy can also be used as the material of core 232 and magnetic field absorption member 233.

In this fixing apparatus 200, as shown in FIG. 3, unfixed toner image 111 can be heat-fixed onto recording paper 109 by transporting recording paper 109 to which unfixed toner image 111 has been transferred from the direction indicated by the arrow so that the surface bearing unfixed toner image 111 is brought into contact with heat-producing sleeve 210.

A temperature sensor 260 comprising a thermistor is positioned so as to be in contact with the rear surface of heat-producing sleeve 210. The temperature of heat-producing sleeve 210 is detected by this temperature sensor 260. The output of temperature sensor 260 is provided to a control apparatus (not shown). Based on the output of temperature sensor 260, this control apparatus controls the power supplied to exciting coil 231 via the exciting circuit so that an optimal image fixing temperature is attained, and by this means the calorific value of heat-producing sleeve 210 is controlled.

Downstream in the recording paper 109 transportation direction, an ejection guide 270 that guides recording paper 109 toward output tray 116 after heat-fixing is finished is provided in the area where heat-producing sleeve 210 is suspended on fixing roller 240.

Coil guide 234 serving as a supporting member is also provided in induction heating apparatus 230, integral with exciting coil 231 and core 232. This coil guide 234 is formed of a resin with a high heat-resistance temperature such as a PEEK material or PPS. The provision of this coil guide 234 makes it possible to prevent damage to exciting coil 231 due to the confinement of heat emitted from heat-producing sleeve 210 in the space between heat-producing sleeve 210 and exciting coil 231.

Although core 232 shown in FIG. 3 has a semicircular cross-section, core 232 need not necessarily have a shape that follows the shape of exciting coil 231, and may, for example, have an approximately Π-shaped cross-section.

A nonmagnetic material is desirable for the heat-producing member of heat-producing sleeve 210. Examples of such nonmagnetic materials are materials such as stainless, aluminum, or copper with a specific resistance of $80\times10^{-6}$ Ωcm (stainless) or less. In fixing apparatus 200 according to this embodiment, nonmagnetic stainless (SUS304) is used for the heat-producing member of heat-producing sleeve 210.

Depending on conditions such as thickness of heat-producing sleeve 210 and the excitation current frequency, a magnetic material such as nickel, cobalt, or iron, for example, can also be used for the heat-producing member of heat-producing sleeve 210.

It is desirable for the thickness of heat-producing sleeve 210 to be around 10 to 500 μm. In this embodiment, the thickness of heat-producing sleeve 210 is assumed to be 200 μm.

It is desirable for heat-producing sleeve 210 to have a conductive layer on its surface. The material of this conductive layer should be copper, silver, aluminum, or the like, for example, and in particular should preferably be a good conductor with a specific resistance of $10\times10^{-6}$ Ωcm or less. As long as this conductive layer forms a surface of heat-producing sleeve 210, it may be provided on either the outer or inner peripheral surface. The conductive layer should preferably be around 5 to 15 μm thick. In this embodiment, a conductive layer of 10±2 μm thick copper plate is provided on the surface of heat-producing sleeve 210.

The frequency of the excitation current of the high-frequency power supply that heats heat-producing sleeve 210 should preferably be in the range from 20 kHz to 100 kHz. In fixing apparatus 200 according to this embodiment, the excitation current frequency is assumed to be 20 kHz to 60 kHz.

Fixing roller 240 is 30 mm in diameter and made of silicone rubber, an elastic foam material with low surface hardness (here, JISA 30 degrees) and low thermal conductivity.

Pressure roller 250 is made of silicone rubber with a hardness of JISA 65 degrees. A heat-resistant resin or other rubber such as fluororubber or fluororesin may also be used as the material of pressure roller 250. It is also desirable for the surface of pressure roller 250 to be coated with resin or rubber such as PFA, PTFE, or FEP, alone or mixed, to increase wear resistance and releasability. Furthermore, it is desirable for pressure roller 250 to be made of a material with low thermal conductivity.

Figure 4:
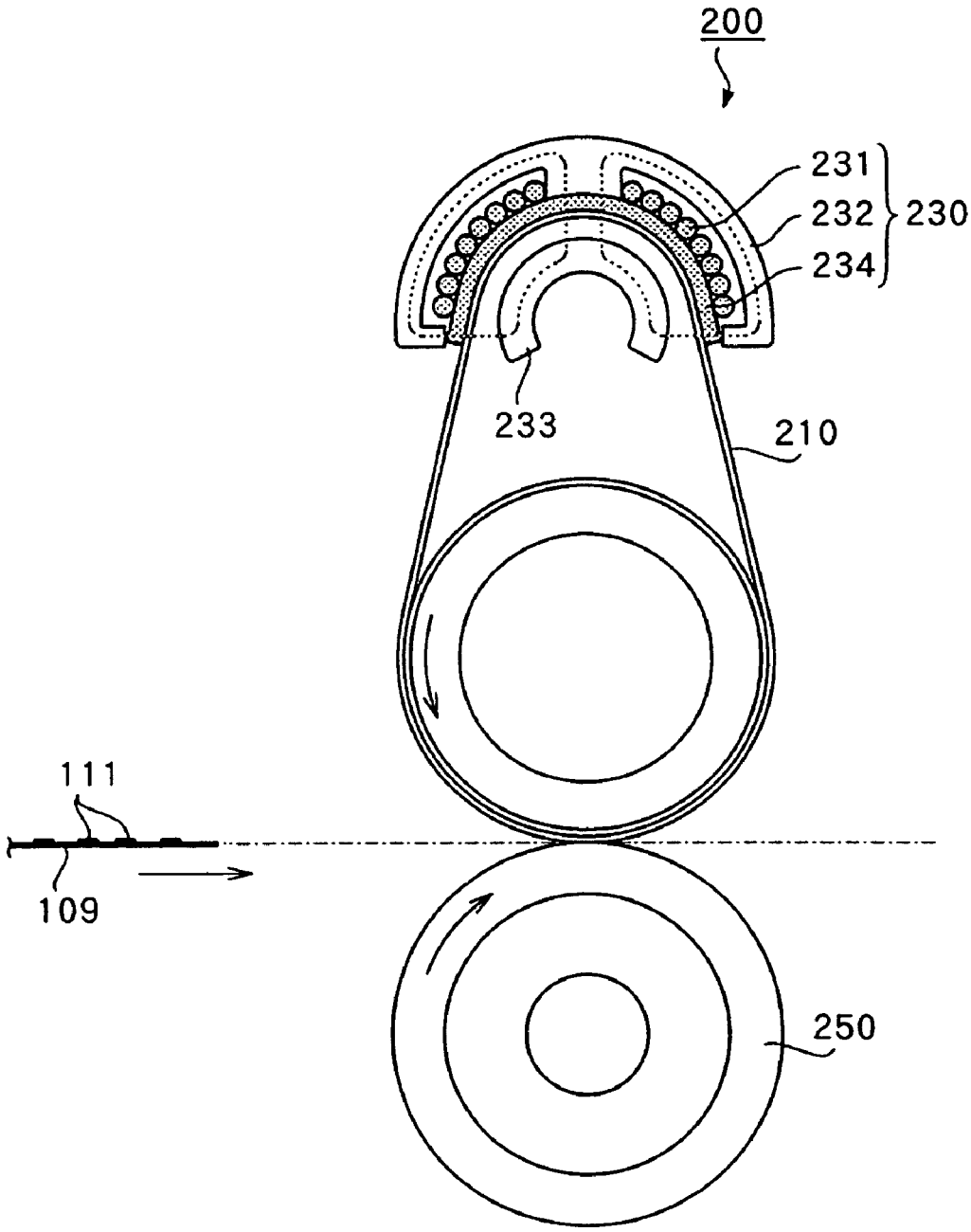
FIG. 4 is a schematic cross-sectional drawing for explaining the operation of a fixing apparatus according to the embodiment.
Figure 5:
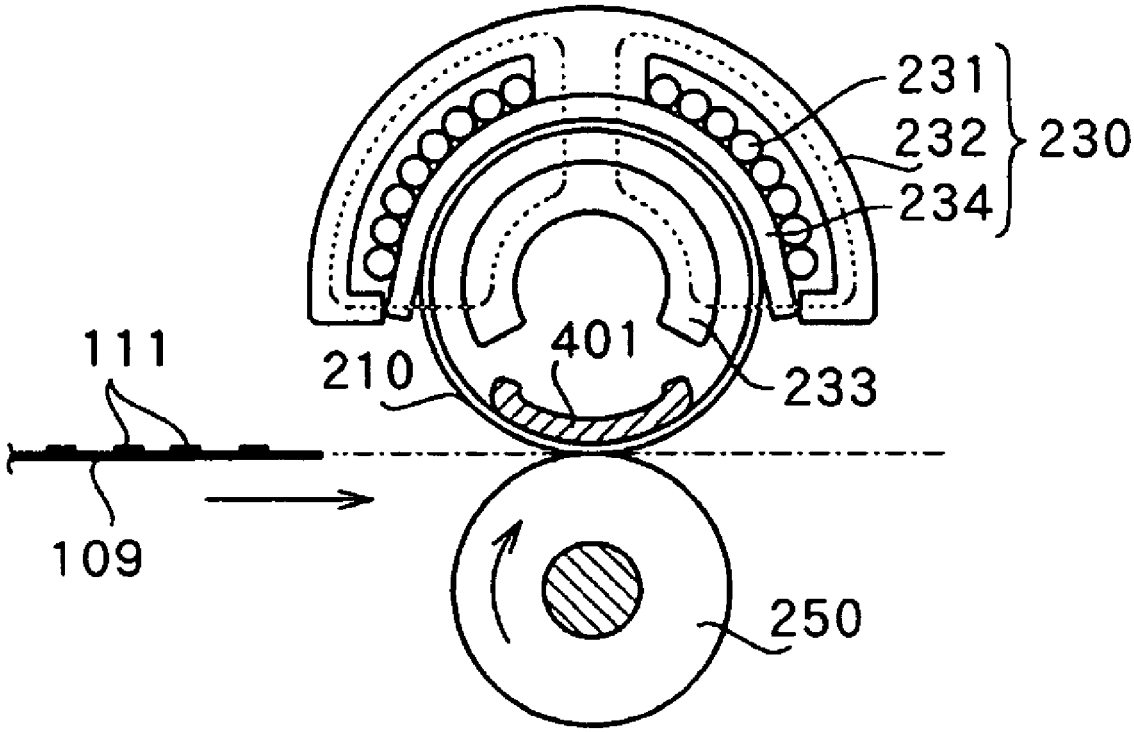
FIG. 5 is a schematic cross-sectional drawing showing another configuration of a fixing apparatus according to the embodiment.

A heat-producing sleeve 210 with such a configuration has magnetic field energy permeability of 89% to 99%. Therefore, in fixing apparatus 200 according to this embodiment, magnetic paths are formed as shown by the dotted lines in FIG. 4 by the exciting circuit, making a configuration where heat-producing sleeve 210 passes through magnetic field energy. Consequently, in this fixing apparatus 200, even if the path of rotation of heat-producing sleeve 210 fluctuates, variation in the generated magnetic field is small, there is little variation in the calorific value of heat-producing sleeve 210, and heat production efficiency can be improved.

In a fixing apparatus according to the Japanese Patent Application Laid-Open No. HEI10-74007, in particular, the path of rotation of the heat-producing rotating element fluctuates and leads to a tendency for the magnetic field generated between the magnetic field generation section and the heat-producing rotating element to vary, and then a state arises in which the calorific value of the heat-producing rotating element becomes unstable, and unevenness of heat production occurs in the direction of rotation of the heat-producing rotating element. In a fixing apparatus according to this embodiment, on the other hand, even if the path of rotation of heat-producing sleeve 210 fluctuates, variation in the generated magnetic field is small, variation in the calorific value of heat-producing sleeve 210 can be kept small, and unevenness of heat production in the direction of rotation of heat-producing sleeve 210 can be reduced.

Also, since the specific resistance of heat-producing sleeve 210 is $80\times10^{-6}$ Ωcm or less in fixing apparatus 200 according to this embodiment, a current flows readily even if the path of rotation of heat-producing sleeve 210 fluctuates. That is to say, with a heat-producing sleeve 210 configured using a nonmagnetic material with specific resistance higher than $80\times10^{-6}$ Ωcm, although the conversion rate from magnetic field energy to thermal energy is higher, current flows less readily, with the result that thermal efficiency falls and heat production becomes more difficult.

If heat-producing sleeve 210 is made of a nonmagnetic stainless material (SUS304) with a high resistivity of 72 μΩcm, magnetic flux passes through heat-producing sleeve 210 without being masked, and heat production is consequently extremely small even with a thickness of 0.2 mm. This heat-producing sleeve 210 also has good mechanical strength and enables the strength necessary for suspension to be secured, allowing the heat capacity of heat-producing sleeve 210 to be decreased by reducing its thickness, and enabling startup responsiveness when heating is performed to be further improved.

Furthermore, since the thickness of heat-producing sleeve 210 is in the range from 10 μm to 500 μm in fixing apparatus 200 according to this embodiment, the heat capacity of heat-producing sleeve 210 can be kept small, and startup responsiveness when heat-producing sleeve 210 is heated can be further improved.

Moreover, since there is a conductive layer on the surface of heat-producing sleeve 210 in fixing apparatus 200 according to this embodiment, a current flows readily and the thermal efficiency of heat-producing sleeve 210 can be improved. That is to say, if heat-producing sleeve 210 is made thin and is composed of a nonmagnetic metallic material, although it is difficult for a current to flow even if magnetic field energy passes through, an eddy current can be made to flow readily by providing a conductive layer on the surface. A similar effect is obtained even if further surface processing of that conductive layer is carried out with a nonmagnetic material.

In particular, in fixing apparatus 200 according to this embodiment, heat production efficiency can be amply improved by setting the thickness of the conductive layer provided on heat-producing sleeve 210 to 10±2 μm. In contrast, in a fixing apparatus according to the Japanese Patent Application Laid-Open No. 2004-145368, from the standpoint of securing a nip area between the heating belt and pressure member, the thickness of the conductive layer of the heating belt is set to around 5 μm in order to maintain the flexibility of the heating belt. Therefore, an eddy current cannot be made to flow as readily as in fixing apparatus 200 according to this embodiment, and as a result the heat production efficiency is lower than in fixing apparatus 200 according to this embodiment. Also, since the specific resistance of the conductive layer provided on the surface of heat-producing sleeve 210 is $10\times10^{-6}$ Ωcm or less in fixing apparatus 200 according to this embodiment, a current flows more readily in heat-producing sleeve 210, and the thermal efficiency of heat-producing sleeve 210 can be further improved.

In fixing apparatus 200 according to this embodiment configured in this way, magnetic field energy permeability can be improved to a range from 67% to 99%, and variation of the generated magnetic field due to fluctuation of the path of rotation of heat-producing sleeve 210 can be further reduced.

Fixing apparatus 200 according to this embodiment has been configured with heat-producing sleeve 210 gripped and rotated between fixing roller 240 and pressure roller 250, and curved so as to follow the shape of coil guide 234, but a configuration may also be used in which, for example, heat-producing sleeve 210 is made cylindrical in shape and is gripped and rotated between a fixing guide plate 401 and pressure roller 250 so that a gap is created with respect to coil guide 234. This configuration enables the fixing apparatus to be made smaller.

This application is based on Japanese Patent Application No. 2003-361051, filed on Oct. 21, 2003, the entire content of which is expressly incorporated by reference herein.

INDUSTRIAL APPLICABILITY

As described above, with a fixing apparatus according to the present invention, even if the path of rotation of the heat-producing rotating element fluctuates, variation in the generated magnetic field is small, there is little variation in the calorific value of the heat-producing rotating element, and heat production efficiency of the heat-producing rotating element can be improved, and therefore a fixing apparatus according to the present invention is useful as a fixing apparatus of an electrophotographic or electrostatographic copier, facsimile machine, printer, or the like.

The invention claimed is:

1. A fixing apparatus comprising:

a magnetic field generation section that generates a magnetic field;

a magnetic field absorption section that is located opposite said magnetic field generation section and absorbs the magnetic field generated by said magnetic field generation section; and a heat-producing rotating element that is gripped and rotated by a pair of pressure members so as to pass between said magnetic field absorption section and said magnetic field generation section and is induction-heated by a magnetic field generated by said magnetic field generation section and allows passage of magnetic field energy, wherein said heat-producing rotating element is made of a nonmagnetic metallic material of thickness in a range from 10 μm to 500 μm and specific resistance of $80\times10^{-6}$ Ωcm or less.

2. The fixing apparatus according to claim 1, wherein said heat-producing rotating element has a conductive layer on a surface.

3. The fixing apparatus according to claim 2, wherein said conductive layer is made of a metallic material with specific resistance of $10\times10^{-6}$ Ωcm or less.

4. The fixing apparatus according to claim 1, wherein said magnetic field generation section comprises:

an exciting coil; and an exciting circuit having a high-frequency power supply that supplies predetermined power to said exciting coil, and wherein a frequency of said high-frequency power supply is in a range from 20 kHz to 100 kHz.

5. The fixing apparatus according to claim 1, wherein said heat-producing rotating element has magnetic field energy permeability of 89% or more.

6. An image forming apparatus comprising the fixing apparatus according to claim 1.

* * * * *